United States Patent [19]

Goodman

[11] 4,090,772

[45] May 23, 1978

[54] LOW INSERTION FORCE ELECTRICAL CONNECTOR

[75] Inventor: David Samuel Goodman, Mission Viejo, Calif.

[73] Assignee: International Telephone and Telegraph Corporation, New York, N.Y.

[21] Appl. No.: 761,854

[22] Filed: Jan. 24, 1977

[51] Int. Cl.[2] ..... H01R 13/54

[52] U.S. Cl. ..... 339/258 R

[58] Field of Search ..... 339/258 R, 258 A, 258 P, 339/258 RR

[56] References Cited

U.S. PATENT DOCUMENTS 735,839 8/1903 Stiles ..... 339/258 R

FOREIGN PATENT DOCUMENTS 1,272,094 8/1961 France ..... 339/258 R 313,388 7/1919 Germany ..... 339/258 R

*Primary Examiner*—Joseph H. McGlynn

*Attorney, Agent, or Firm*—Thomas L. Peterson

[57] ABSTRACT

A low insertion force electrical connector in which each pin contact in the connector has a cylindrical body with a gradually tapered forward end terminating in a rounded nose. Each socket contact of the connector comprises a cylindrical body with two spring beams which taper forwardly and inwardly. The inner forward edges of the beams have an arcuate configuration. Specific parameters of the relative dimensions of the contacts and of the configuration of the tapered forward end portion of the pin contact are disclosed which allow the mating pin and socket contacts to mate with forces substantially less than that of standard pin and socket contacts.

12 Claims, 10 Drawing Figures

LOW INSERTION FORCE ELECTRICAL CONNECTOR

BACKGROUND OF THE INVENTION

This invention relates generally to electrical connectors and, more particularly, to a low insertion force electrical connector.

It is common practice in aircraft to mount avionics "black boxes" on shelves with an electrical connector member mounted on the back of each box which engages with a mating connector half mounted on the rear of the shelf when the box is slid fully to the rear of the shelf. The avionics "black box" contains electronic circuitry and components necessary for controlling the various functions of the aircraft. As aircraft avionics become more complex, the number of the wires required to connect the box to the aircraft's wiring increases. The forces required to mate the two connector halves of the connector associated with each box now used in these applications is proportional to the number of contacts. For example, a box having approximately 600 contacts has an insertion or mating force of about 200 lbs. It is, therefore, desirable that a connector be utilized for this application which has a relatively low insertion force.

A variety of zero insertion force electrical connectors are known in the art. Generally speaking, these connectors are coupled with zero insertion force and, thereafter a secondary operation, such as turning a knob or handle, is required to effect engagement between the contacts in the mating connector halves. An example of such a connector is disclosed in U.S. Pat. No. 3,594,698 to Anhalt. In this connector, one connector half contains a plurality of fixed contacts while the second connector half contains a plurality of movable contact. An actuating plate is provided in such second connector half which, when shifted by a cam shaft, moves the movable contacts into electrical engagement with the fixed contacts in the first connector half. While such a zero insertion force connector provides the desired result of minimizing insertion or engagement forces of the mating connector halves, the aircraft industry has expressed a preference for utilizing electrical connectors for their avionics "black boxes" which do not require the secondary operation of actuating the contacts. Therefore, it is the purpose of the present invention to provide an electrical connector in which the connector halves may be mated with substantially lower forces than standard electrical connectors and without the necessity of operating an actuator to bring the contacts into engagement after the connector halves are mated. Another object of the invention is to provide such a connector having pin and socket contacts which are matable with standard pin and socket contacts and which may be reliably produced at a reasonable cost competitive with the cost of manufacturing standard pin and socket contacts.

SUMMARY OF THE INVENTION

According to the principal aspect of the present invention, there is provided a pin and socket combination for a low insertion force electrical connector. The pin contact has a cylindrical body with a tapered forward end terminating in a nose. The cylindrical body is joined to the tapered forward end by a blended radius. The socket contact has a cylindrical body with at least two forwardly extending spring beams of arcuate cross-section. The beams taper forwardly and inwardly to define a generally circular entrance for the pin contact. The inner forward edges of the beams at the entrance of the socket contact are tapered and joined to the inner surface of the beams by blended radii. The ratio of the length of each beam to the outside diameter of the socket contact cylindrical body is between 2 and 5. The ratio of the diameter of the circular entrance of the socket contact to the diameter of the pin contact cylindrical body is at least 0.7. The tapered forward end of the pin contact has a shape bounded by surfaces of revolution generated about the longitudinal axis of the pin contact defined by two equations for elliptical curves which will be defined later herein. The engaging surface of at least one of the contacts has a finish smoother than 32 *u* inch. A pin and socket combination as defined hereinabove and as disclosed in detail later in this specification has insertion and withdrawal forces about one-third as great as that of standard pin and socket contacts. Therefore, the present invention provides a low insertion force electrical connector which does not require a secondary operation to actuate the contacts therein. In addition, the contacts may be reliably produced at a cost on the order of that required to manufacture standard pin and socket contacts. Further, the contacts of the invention are matable with standard pin and socket contacts.

DESCRIPTION OF THE PREFERRED EMBODIMENT

Figure 1:
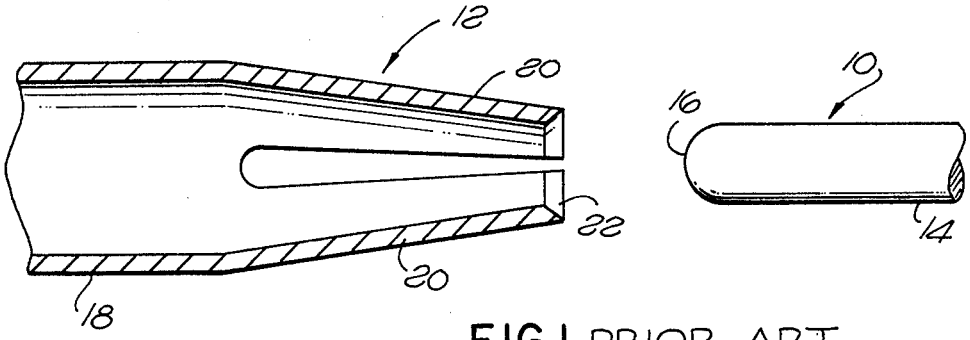
FIG.1 PRIOR ART
FIG. 1 illustrates in longitudinal section, the forward end of a socket contact and, in side elevation, a mating pin contact having a hemispherical forward end, each of the type commonly utilized in standard electrical connectors.
Figure 2:
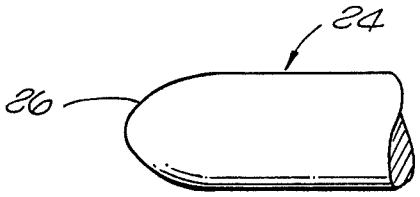
FIG. 2 PRIOR ART
FIG. 2 is a side elevation of the forward end of another form of prior art pin contact having a somewhat bullet shaped configuration.

Reference is made to FIG. 1 of the drawings in detail which illustrates a pin contacts 10 and a mating socket contact 12 of the type commonly utilized in standard electrical connectors. The pin contact has a cylindrical body 14 terminating in a rounded hemispherical forward end 16. The socket contact has a hollow cylindrical body 18 which is longitudinally slotted at its forward end to define two forwardly extending spring beams 20 of arcuate cross-section. The inner forward edges of the beams 20 are tapered or bevelled, as indicated at 22, to provide an entrance for the rounded forward end 16 of the pin contact. FIG. 2 illustrates another prior art pin contact 24 which has a generally blunt bullet shaped forward end 26. The insertion force of size 22 pin and socket contacts as illustrated in FIG. 1 is about 5.9 ounces. The insertion force of a size 22 pin contact as shown in FIG. 2 when mated with a standard socket contact, such as the contact 12, is approximately 4.7 ounces. While such forces are acceptable for connectors containing about 50 contacts or less, the forces would be undesirably high for connectors containing one or several hundred mating contacts such as illustrated in avionics black boxes.

Figure 3:
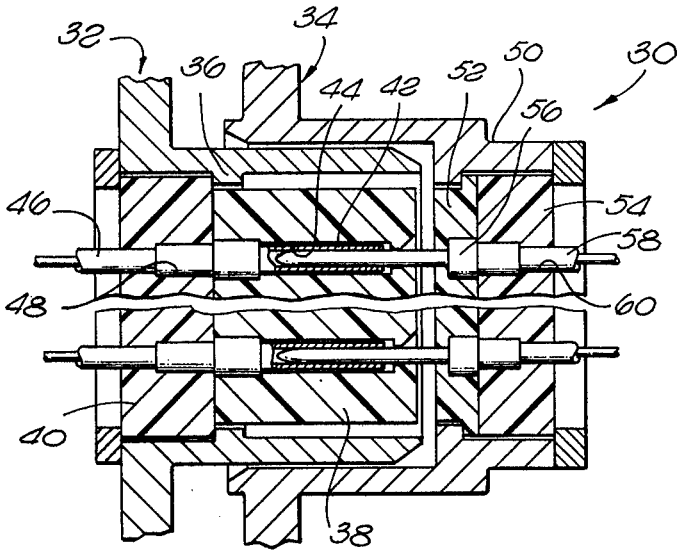
FIG. 3 is a longitudinal sectional view of a low insertion force electrical connector embodying the pin and socket contacts of the present invention.

Reference is now made to FIG. 3 of the drawings which illustrates a low insertion force electrical connector, generally designated 30, which embodies the novel pin and socket contacts of the present invention, to be described in detail later in connection with FIGS. 4 to 10. The connector 30 is of conventional construction, except for the contacts, and comprises a plug connector member 32 and a mating receptacle connector member 34. The plug member 32 comprises a shell 36 containing a front insulator 38 and rear insulator 40. A pair of socket contacts 42 are shown mounted in cavities 44 in the front insulator 38. Conductors 46 connected to the rear of the socket contacts pass rearwardly through openings 48 in the rear insulator 40.

The receptacle connector member 40 comprises a shell 50 containing a front insulator 52 and rear insulator 54. Pin contacts 56 are mounted in the front insulator 52 in alignment with the socket contacts 42. Conductors 58 terminated to the pin contacts extend rearwardly through openings 60 in the rear insulator 54. While only two pairs of mating pin and socket contacts are illustrated in FIG. 3, it will be appreciated that the connector 30 may contain up to several hundred contacts.

Referring first to the socket contact 42 illustrated in FIGS. 7 to 10, it is noted that the contact is generally similar to the socket contact 12 illustrated in FIG. 1. The socket contact 42 has a hollow cylindrical body 64 with two forwardly extending spring beams 66 of arcuate cross-section. More than two beams could be provided, if desired. The beams are sized by collapsing them to a suitable dimension so that the beams taper forwardly and inwardly. The forward ends of the beams 66 define a circular entrance 68. The spring beams 66 function as cantilever beams. The deflection force of the beams is dependent upon the length of the beams. In order to reduce the insertion force of the pin contact 56 into the socket contact, the ratio of the length L of each beam 66 to the outside diameter D of the cylindrical body 64 of the socket contact is between 2 and 5.

Figure 9:
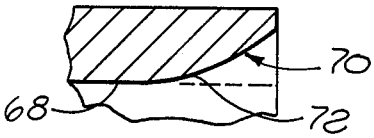
FIG. 9 is a greatly enlarged fragmentary view showing the forward end of one of the spring beams of the socket contact of FIGS. 7 and 8.
Figure 10:
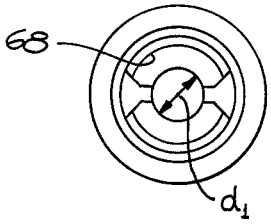
FIG. 10 is a front end view of the socket contact illustrated in FIG. 7.

In addition, in order to minimize the insertion force of the pin contact into the socket contact, the inner forward edge 70 of each spring beam 66 is tapered and joined to the inner surface of the beam, or the circular entrance 68, by a blended radius 72, as best seen in FIG. 9. Preferably, the inner forward edge 70 is gradually tapered so as to have a longitudinally arcuate configuration in order to minimize insertion forces. The arcuate inner edge 70 of each beam may have a constant radius, as illustrated, or may have a somewhat gradually tapered bullet configuration similar to the tapered forward end of the pin contact, which will be described later herein.

The pin contact 56 has a cylindrical body 74 with a tapered forward end 76 terminating in a rounded or hemispherical nose 78. Referring again to FIG. 1, when the pin contact 10 is mated with the socket contact 12 in a standard pin and socket combination, the beams 20 of the socket contact must be separated or deflected before the pin contact can enter into the socket contact. In accordance with the present invention, the radius $R_1$ of the nose 78 of the pin contact is sufficiently small that the nose will enter into the circular entrance 78 of the socket contact without engagement, even considering pin and socket position float within the insulators in the mating connector members 32 and 34. Therefore, the pin contact initially enters the socket contact in the present invention with zero insertion force.

In order to reduce the insertion force of the pin contact into the socket contact after the nose 78 initially enters the entrance 68 in the socket contact, the forward end 76 of the pin contact has a relatively great taper and is joined to the cylindrical body 74 by a blended radius 80, and to the rounded nose 78 by another blended radius 82. Preferably the radius $R_1$ of the rounded nose 78 is selected to blend with the tapered forward end 76.

Figure 5:
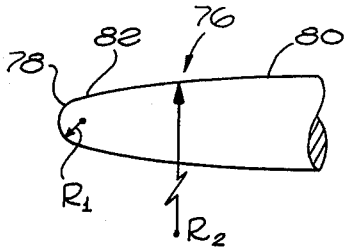
FIG. 5 is a greatly enlarged side elevational view of the forward end of the pin contact illustrated in FIG. 4, illustrating the radii utilized to define the shape of the forward end of the contact.
Figure 6:
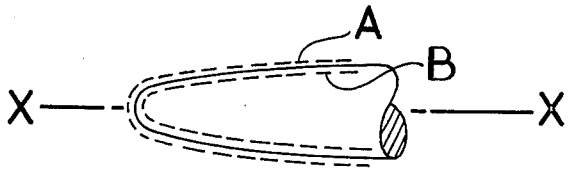
FIG. 6 is a side elevational view similar to FIG. 5 in which elliptical curves A and B are illustrated which define the configuration of the forward end of the contact.
Figure 7:
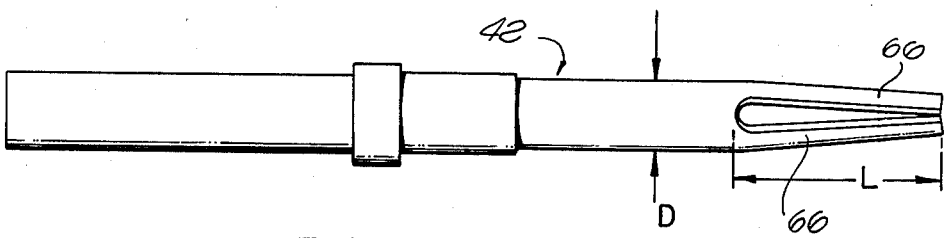
FIG. 7 is an enlarged side elevational view of one of the socket contacts illustrated in FIG. 3 which is matable with the pin contact illustrated in FIGS. 4 to 6.
Figure 8:
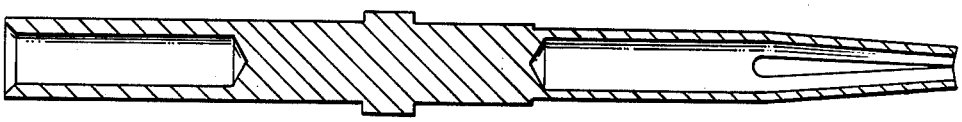
FIG. 8 is a longitudinal sectional view through the socket contact of FIG. 7.

Preferably the forward end 76 of the pin contact is gradually tapered or curved to provide a longitudinally arcuate configuration. The surface of the curved forward end 76 may be defined by a constant radius $R_2$, as seen in FIG. 5, which blends with the constant radius rounded nose 78 and the cylindrical outer surface of the body 74.

Figure 4:
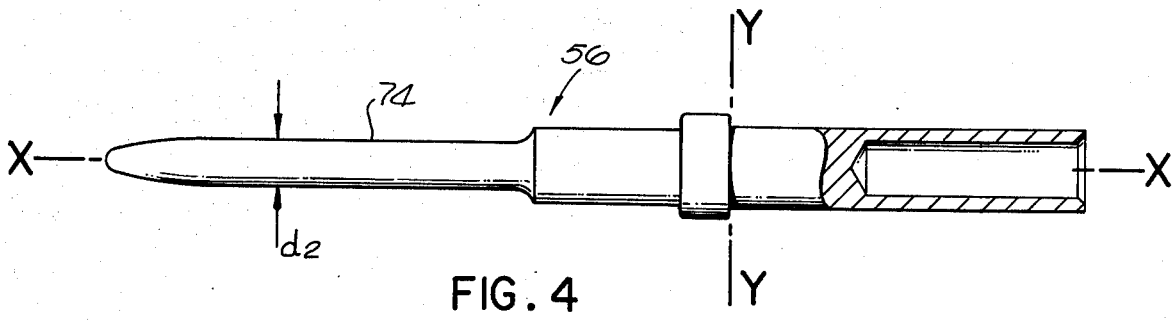
FIG. 4 is an enlarged side elevational view of the pin contact utilized in the connector illustrated in FIG. 3, with the rear of the contact shown in longitudinal section.

In order to minimize insertion forces, it is important that the ratio of the diameter of the circular entrance $d_1$ of the socket contact (see FIG. 10) to the diameter $d_2$ of the pin contact body 74 (see FIG. 4) be at least 0.7. It is also essential in order to obtain substantially reduced insertion forces that the tapered forward end 76 of the pin contact have a shape bounded by surfaces of revolution generated about the X axis of the following equations for ellipses:

$$X^2 + 0.690X + 27.563\ Y^2 - 27.444 = 0 \text{ and}$$

$$X^2 + 0.690X + 22.563\ Y^2 - 22.444 = 0$$

where the X axis coincides with the longitudinal axis of the pin contact and the Y axis is perpendicular to the longitudinal axis, as seen in FIG. 4. The elliptical curves defined by the foregoing equations are indicated by the dash line curves designated A and B in FIG. 6.

To match the foregoing pin contact, it is preferred that the inner forward edges 70 of the spring beams 66 of the socket contacts have an arcuate form bounded by surfaces of revolution generated about the X axis by the following equations:

$$X^2 - 0.742X + Y^2 - 0.116Y + 0.139 = 0$$

$$X^2 - 0.718X + Y^2 - 0.108Y + 0.131 = 0$$

wherein the X axis is the longitudinal axis of the socket contact and the Y axis is perpendicular to the longitudinal axis. It is noted that the foregoing equations define a circular configuration, in contrast to the elliptical curves defined by the equations applicable to the forward end 76 of the pin contact. The circular configuration of the forward edges 70 is preferred because of ease of manufacture; however, as stated previously herein, the curved edges 70 may have a somewhat elliptical configuration such as the tapered forward end 76 of the pin contact.

It is also necessary in order to obtain low insertion forces between the mating pin and socket contacts that the engaging surface of at least one of the contacts have a finish smoother than 32$\mu$ inch. The engaging surfaces of the contacts are those surfaces of the contacts which come into contact with each other when the pin contact is inserted into the socket contact. Generally speaking, the engaging surface of the socket contact is the rounded edges 70, blended radius 72, and the circular entrance or inner surface 68 of the beams while the engaging surface of the pin contact is the tapered forward end 76 and the cylindrical body 74 behind the forward end which is engaged by the socket contact beams 66. It is, of course, preferred that the entire forward mating ends of the pin and socket contacts have a smooth finish. In order to obtain the lowest possible insertion forces, it is preferred that the engaging surfaces of both the pin and socket contacts have a finish of about 16$\mu$ inch or smoother.

The maximum insertion force of a pair of size 22 pin and socket contacts as illustrated in FIGS. 4 to 10 and described hereinabove (having a 16$\mu$ inch finish) has been found to be 1.5 oz. Two electrical connectors have been tested, one containing 212 size 22 standard pin and socket contacts as illustrated in FIG. 1, and the other containing size 22 pin and socket contacts in accordance with the present invention, as illustrated in FIGS. 4 to 10. The insertion force of the connector containing the standard contacts was 72 lbs., while the insertion force of the new connector was only 23 lbs. Thus, the insertion force of the contacts of the present invention is approximately one third of that of the prior art contacts. In another test, a connector containing 300 size 22 pin and socket contacts constructed in accordance with the present invention was found to have an insertion force of only 30 lbs. It is also noted that the design of the pin and socket contacts of the present invention yields an insertion versus withdrawal force of approximately 1 to 1 ratio whereas in the standard design of a pin and socket contact, the ratio is 2 to 1 or greater. Therefore, as seen by the specific design, shape, and dimensional relationships of the mating parts of the pin and socket contacts of the present invention, there is achieved a pin and socket contact combination which yields substantially lower insertion forces than the pin and socket contacts known heretobefore. Furthermore, the pin and socket contacts of the present invention are interengageable with standard pin and socket contacts, they may be readily produced on standard machinery, and the cost of manufacture is on the order of that incurred in manufacturing standard contacts.

What is claimed is:

1. A pin and socket combination for a low insertion force electrical connector comprising:

a pin contact having a cylindrical body with a tapered forward end terminating in a nose, said tapered forward end having a longitudinally arcuate configuration extending from the nose of the pin contact to the cylindrical body thereof, said cylindrical body being joined to said tapered forward end by a blended radius, the longitudinally extending surface of said cylindrical body being parallel to a center axis of the pin contact;

a socket contact having a cylindrical body with at least two forwardly extending spring beams of arcuate cross-section, said beams tapering forwardly and inwardly to define a generally circular entrance for said pin contact;

the inner forward edges of said beams at said entrance being tapered and joined to the inner surfaces of said beams by blended radii;

the ratio of the length of each said beam to the outside diameter of said socket contact cylindrical body being between 2 and 5;

the ratio of the diameter of said circular entrance of said socket contact to the diameter of said pin contact cylindrical body being at least 0.7 when said pin contact is removed from said socket contact;

said tapered forward end of said pin contact having a shape bounded by surfaces of revolution generated about the X axis by the equations:

$$X^2 + 0.690X + 27.563\ Y^2 - 27.444 = 0 \text{ and}$$

$$X^2 + 0.690X + 22.563\ Y^2 - 22.444 = 0$$

where the X axis coincides with the longitudinal axis of said pin contact and the Y axis is perpendicular to said longitudinal axis; and the engaging surface of at least one of said contacts having a finish smoother than 32$\mu$ inch.

2. A pin and socket contact combination as set forth in claim 1 wherein:

said nose of said pin contact is rounded.

3. A pin and socket contact combination as set forth in claim 1 wherein:

said engaging surface has a finish of about 16$\mu$ inch or smoother.

4. A pin and socket contact combination as set forth in claim 1 wherein:

the engaging surfaces of both said contacts have finishes of about 16$\mu$ inch or smoother.

5. A pin and socket contact combination as set forth in claim 1 wherein:

said inner forward edges of said beams having a longitudinal arcuate configuration.

6. A pin and socket contact combination as set forth in claim 5 wherein:

said inner forward edges of said beams have an arcuate form bounded by surfaces of revolution generated about the X axis by the equations:

$$X^2 - 0.742X + Y^2 - 0.116Y + 0.139 = 0 \text{ and}$$

$$X^2 - 0.718X + Y^2 - 0.108Y + 0.131 = 0$$

where the X axis is the longitudinal axis of said socket contact and the Y axis is perpendicular to said longitudinal axis.

7. A low insertion force pin contact comprising:

a cylindrical body having a tapered forward end terminating in a nose, said tapered forward end having a longitudinally arcuate configuration extending from the nose of the pin contact to the cylindrical body thereof, said cylindrical body being joined to said tapered forward end by a blended radius, the longitudinally extending surface of said cylindrical body being parallel to a center axis of the pin contact;

said tapered forward end of said pin contact having a shape bounded by surfaces of revolution generated about the X axis by the equations:

$$X^2 + 0.690X + 27.563\ Y^2 - 27.444 = 0 \text{ and}$$

$$X^2 + 0.690X + 22.563\ Y^2 - 22.444 = 0$$

where the X axis coincides with the longitudinal axis of said pin contact and the Y axis is perpendicular to said longitudinal axis; and the surface of said tapered forward end having a finish smoother than 32$\mu$ inch.

8. A pin contact as set forth in claim 7 wherein: said nose is rounded.

9. A pin contact as set forth in claim 7 wherein: the surface of said tapered forward end has a finish of about 16$\mu$ inch or smoother.

10. A low insertion force electrical connector comprising:

a pair of mating connector members;

a plurality of pin contacts mounted in one of said connector members;

a plurality of socket contacts mounted in the other connector member adapted to receive said pin contacts when said connector members are mated;

said pin contact comprising a cylindrical body having a tapered forward end terminating in a nose, said tapered forward end having a longitudinally arcuate configuration extending from the nose of the pin contact to the cylindrical body thereof, said cylindrical body being joined to said tapered forward end by a blended radius, the longitudinally extending surface of said cylindrical body being parallel to a center axis of the pin contact;

said tapered forward end of said pin contact having a shape bounded by surfaces of revolution generated about the X axis by the equations:

$$X^2 + 0.690X + 27.563\ Y^2 - 27.444 = 0 \text{ and}$$

$$X^2 + 0.690X + 22.563\ Y^2 - 22.444 = 0$$

where the X axis coincides with the longitudinal axis of said pin contact and the Y axis is perpendicular to said longitudinal axis; and the surface of said tapered forward end having a finish smoother than 32$\mu$ inch.

11. An electrical connector as set forth in claim 10 wherein: said socket contact comprises cylindrical body having at least two forwardly extending spring beams of arcuate cross-section, said beams tapering forwardly and inwardly to define a generally circular entrance for said pin contact;

the inner forward edges of said beams at said entrance being tapered and joined to the inner surfaces of said beams by blended radii;

the ratio of the length of each said beam to the outside diameter of said socket contact cylindrical body being between 3 and 4.5; and the ratio of the diameter of said circular entrance of said socket contact to the diameter of said pin contact cylindrical body being at least 0.7.

12. An electrical connector as set forth in claim 11 wherein:

said inner forward edges of said beams have a form bounded by surfaces of revolution generated about the X axis by the equations:

$$X^2 - 0.742X + Y^2 - 0.116Y + 0.139 = 0 \text{ and}$$

$$X^2 - 0.718X + Y^2 - 0.108Y + 0.131 = 0$$

where the X axis is the longitudinal axis of said socket contact and the $Y$ axis is perpendicular to said longitudinal axis.

* * * * *